US005961167A

United States Patent [19]

Gilley

[11] Patent Number: 5,961,167

[45] Date of Patent: Oct. 5, 1999

[54] METHOD AND APPARATUS FOR REMOVING ANIMAL EXTRACT EXCREMENT

[76] Inventor: Bonita Ré Gilley, 7440 SW. 107th Ave., Miami, Fla. 33173-2986

[21] Appl. No.: 08/872,613

[22] Filed: Jun. 10, 1997

Related U.S. Application Data

[60] Provisional application No. 60/019,698, Jun. 10, 1996.

[51] Int. Cl.[6] ..... A01K 29/00; A41D 19/00

[52] U.S. Cl. ..... 294/1.3; 2/159; 294/25

[58] Field of Search ..... 294/1.3, 25, 131; 2/16, 20, 158–160, 161.6–161.8; 15/104.8, 227; 206/278, 438; 383/4

[56] References Cited

U.S. PATENT DOCUMENTS

| | | | |
|---|---|---|---|
| 2,795,806 | 6/1957 | Suttles | 15/227 X |
| 3,638,789 | 2/1972 | Tuszewski | 15/227 X |
| 3,870,150 | 3/1975 | Hummel | 15/227 X |
| 4,071,921 | 2/1978 | Jury | 15/227 |
| 4,347,931 | 9/1982 | Ginger et al. | 15/227 X |
| 4,645,251 | 2/1987 | Jacobs | 294/1.3 |
| 4,677,697 | 7/1987 | Hayes | 294/25 X |
| 4,876,747 | 10/1989 | Coffey et al. | 2/161.7 X |
| 4,937,881 | 7/1990 | Heise | 291/1.3 X |
| 5,301,806 | 4/1994 | Olson | 294/1.3 X |
| 5,438,708 | 8/1995 | Jacovitz | 2/161.6 |

FOREIGN PATENT DOCUMENTS

| | | | |
|---|---|---|---|
| 2649143 | 1/1991 | France | 294/1.3 |
| 2237973 | 5/1991 | United Kingdom | 294/1.3 |

*Primary Examiner*—Johnny D. Cherry
*Attorney, Agent, or Firm*—Robert M. Schwartz

[57] ABSTRACT

A disposable, invertible, expandable, symmetrical, sleeved, collecting glove, providing the method and apparatus for grasping, removing, containing, and disposing of a targeted mass and is of the type having a glove (10) formed in a flattened elongated tubular plastic sleeve (11) which simultaneously communicates at its palm with an attached absorbent cover sheet (32) to grasp the mass. The glove is interchangeable in that it will fit either a right-handed or left-handed collector. The materials of the the glove and sleeve are of flexible, thin gauge plastic, sufficiently strong for the grasping region (26) to effectively grasp and envelope such a mass. In addition, a central process of inversion begins in the grasping region (26) of the sleeved glove, causing the grasping (26) to prolapse, creating a region of irregular folds (33) that can bulge and expand to increase capacity and absorbency. The sleeved glove will, at that moment, be converted into its own spacious inside-out bag for safe containment and disposal of the mass.

10 Claims, 3 Drawing Sheets

METHOD AND APPARATUS FOR REMOVING ANIMAL EXTRACT EXCREMENT

This application claims the benefit of U.S. Provisional application Ser. No. 60/019,698, filed on Jun. 10, 1996.

BACKGROUND—FIELD OF INVENTION

The present Method And Apparatus For Removing Animal Extract Excrement, a sleeved collecting glove, relates to the sanitary removal of undesirable masses.

BACKGROUND—DESCRIPTION OF PRIOR ART

In today's society it has become essential, especially in view of newly passed laws and statutes in many municipalities, that a dog owner must collect animal excrement at the time of the excretion, and properly dispose of same. There have been many devices designed to attempt to perform this procedure, such as 'pooper scoopers,' shovels, paper cups, etc. Even saved plastic grocery bags have been used to attempt to solve this problem. Additionally, gloves were used. However, they do not work as well. They are not large enough, cannot be turned inside out as shown below and they are expensive.

Existing collecting apparatuses of the non-disposable type are large, cumbersome and expensive. They have hooks, claws or other sharp, pointed and jagged parts. These features are too dangerous for a child to use. They require care and effort to rinse, or to soak and clean, and to store for reuse. A more recent example, U.S. Pat. No. 4,741,565 to Bagg (1988) disclosed a handled and hooked shovel that, at first glance, appeared more like a defense weapon and could possibly be used as such. The trend today is to minimize the availability of potential weapons around the home.

Others were less cumbersome, but were invented for protection from exposure. Some were designed as garment devices for hand and for foot with adhesive bands, U.S. Pat. No. 4,937,881 to Heise (1990).

Other inventors have pursued the disposable apparatus approach of the more complex type including handles, U.S. Pat. No. 5,438,708 to Jacovitz (1995); or rigid structures such as a stiffened pouch, U.S. Pat. No. 4,845,781 to Strickland (1989). U.S. Pat. No. 5,222,777 to Clonch (1993) shows rigid material that is accordion-like. Another invention has pleats and a tie, U.S. Pat. No. 4,964,188 to Olson (1990).

Other disposable apparatuses showing less complexity than the above, include U.S. Pat. No. 4,788,733 to Lerner (1988), which proposes a towel layer and a tie version. U.S. Pat. No. 4,677,697 to Hayes (1987) has a fastener cut with a tie strip.

Still others are U.S. Pat. No. 4,768,818 to Kolic (1988), illustrating a mitt which circumferentially wraps a loaded and closed pocket, and U.S. Pat. No. 5,149,159 to Bardes (1992) which is gusseted to have a "W"-shape in its cross-section and is interchangeable.

These inventions and all others searched and researched lack the advantages needed to prompt, provide, and promote activity required to solve the problem. Not one of the existing inventions has all the features to solve the problem safely, conveniently, effectively, economically, sanitarily and ecologically. This growing problem is rapidly reaching smelly proportions.

Consequently all of the inventions heretofore known suffer from a plethora of disadvantages:

(a) Not one of the above is popular with the user public.

(b) They are too costly to manufacture.

(c) None has been broadly marketed.

(d) They are not packaged for convenient or quick access.

(e) They are too complicated to use and seal securely.

(f) They are unhygienic in that they create health hazzards.

(g) They are unaesthetic in that the appearance should belie their repulsive use.

(h) None arouses public awareness.

OBJECTS AND ADVANTAGES

One of the most exciting times in a person's life, whether younger or older, is when that person proudly comes home with a new canine friend. The bonding that takes place at that time is a beautiful thing to see. What isn't so beautiful to see is the responsibility and the reality that comes with ownership. The realities of feeding and watering are evident. What happens when you feed and water? Yes . . . THE POOP!! Not a joking matter. The tensions that develop can be disastrous, not so much to the owner-animal relationship, but to the family, the neighbors, and the community. If a different approach isn't taken, and taken soon, not only our backyards, but our parks and our camping grounds will become noxious.

"Collecting" is a positive word, as is the word "recycling". Recycling came about by careful studies, paid for with our tax dollars. The studies themselves, considered collectively were on safety, convenience, effectiveness, economy, sanitation and ecology, and they became "the collective means for action". That definition, in itself, is the clue to the effective approach to educating the public to resort to . . . the collecting of masses . . . in mass.

Thus, the Method And Apparatus For Removing Animal Extract Excrement—a disposable, invertible, expandable, symmetrical, sleeved, collecting glove, better referred to as—the collecting glove.

Accordingly, several objects and advantages of the present collecting glove are:

(a) to provide a collecting glove to the public at a reasonable cost which will provide benefits far outweighing the expense;

(b) to provide a collecting glove that is very light in weight, occupies very little space, making it easy to have available at all times;

(c) to provide collecting gloves folded or packaged resembling a purse size package of tissues;

(d) to provide a collecting glove that is safe to use by protecting the collector from direct contact at all times;

(e) to provide a collecting glove that is logical to the user and doesn't require much instruction if any;

(f) to provide a collecting glove design that can easily and economically be manufactured, preferably of recyclable materials;

(g) to provide a collecting glove that is durable, and is effective for it's one time use;

(h) to provide a collecting glove that not only has novelty, but appeal, as it makes a repulsive task bearable;

(i) to provide a collecting glove that makes living easier and more pleasant for all concerned;

(j) to provide a collecting glove that is as reliable as a zip lock bag and can be carried on one's person after use without concern for further contamination;

(k) to provide a collecting glove that has an ecological advantage that must be emphasized strongly to both adults and children;

(l) to provide a collecting glove that will be as easy to sell to the general public as wet wipes and paper towels for gross, messy clean-ups;

(m) to provide a collecting glove that far exceeds the aesthetics of any other collecting method or device;

(n) to provide a collecting glove that enables accuracy at the targeted mass because the hand has tactile perception;

(o) to provide a collecting glove that has popularity among users, and can keep up with the growing population of pet owners and the demand for collection;

(p) to provide a collecting glove that becomes the "jazzy little tool" that will arouse public awareness and increase product excitement and demand;

(q) to provide a collecting glove that is popular and will promote distribution through local stores and pet shops and will be as convenient to buy as candy at the checkout counter;

(r) to provide a collecting glove that will engender a whole new product line;

Further objects and advantages of the disposable collecting glove will become apparent after reading the following, and after consideration of the drawings and ensuing description.

DRAWING FIGURES

In the drawings, related referenced parts and points have the same numeral but are viewed from different planes. The numerals are not sequential, and the letter P in FIG. 2 and FIG. 4 references the points of the corresponding numbered part or approximate region.

REFERENCE NUMERALS IN DRAWINGS

FIG. 1

Figure 1:
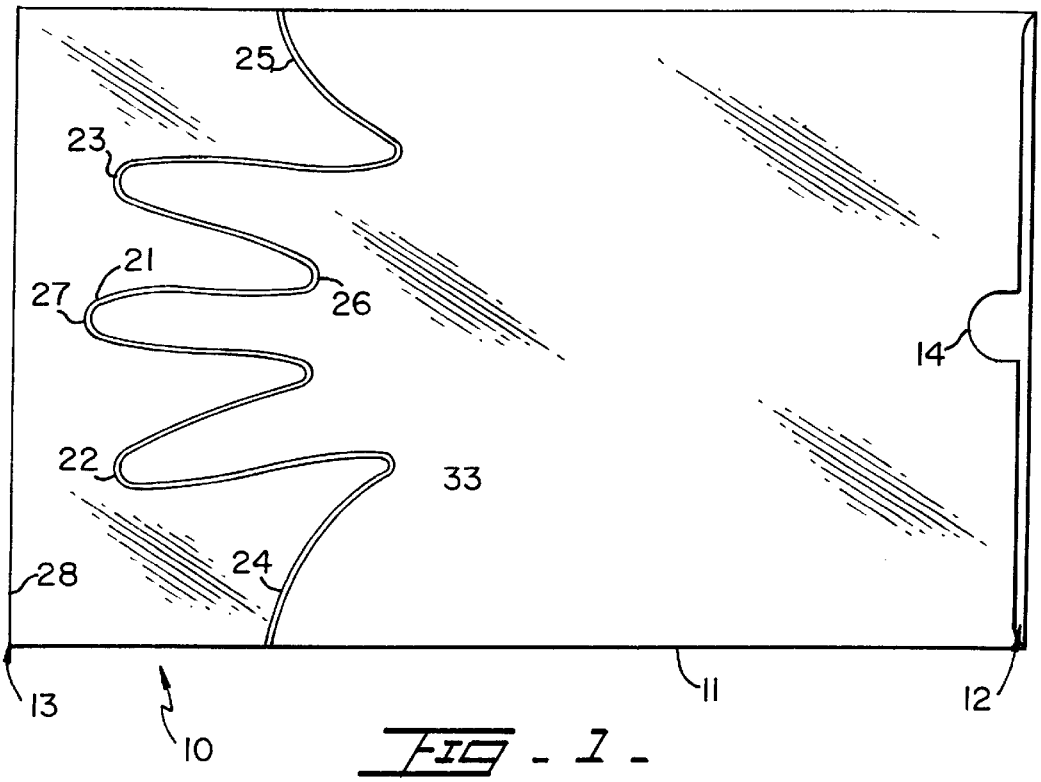
FIG. 1 shows a plan view of the collecting glove supplied by the elongated tubular sleeve, sealed at one end, and a groove at the opposite open end, and further shows the reinforced symmetrical seal that outlines the interchangeable grasping region.

10 glove
11 elongated tubular sleeve
12 open end of sleeve or cuff
13 sealed end of sleeve
14 groove
21 middle fingerstall
22 second fingerstall
23 third fingerstall
24 thumb space for right hand fit or little finger space for left hand fit
25 thumb space for left hand fit or little finger space for right hand fit
26 reinforced symmetrical seal defining grasping region
27 tip of middle fingerstall
28 sleeve end seal
33 region of irregular folds

FIG. 2

10 glove
12 open end of sleeve
13 sealed end of sleeve or cuff
26P seal point at base of fingerstalls
27P seal point at tip of middle fingerstall
28P seal point at end of sleeve
30 top layer
31 intermediate layer
32 absorbent cover sheet
33P point of region of irregular folds

FIG. 3

10 glove, concealed
11 elongated tubular sleeve, inverted inside-out
12 open end of sleeve or cuff
13 sealed end of sleeve, concealed
14 groove
21 middle fingerstall, concealed
22 second fingerstall, concealed
23 third fingerstall, concealed
24 thumb space for right hand fit or little finger space for left hand fit, concealed
25 thumb space for left hand fit or little finger space for right hand fit, concealed
26 reinforced symmetrical seal defining grasping region
27 seal at tip of middle fingerstall, concealed
28 sleeve end seal, concealed
33 region of irregular folds

FIG. 4

12 open end of sleeve
13 sealed end of sleeve
26P seal point at base of fingerstalls
27P seal point at tip of middle fingerstall
28P seal point at end of sleeve
30 top layer, greater part inverted
31 intermediate layer, greater part inverted down under
32 absorbent cover sheet, greater part inverted down under
33P point of region of irregular folds
34 area of the mass

FIG. 5

11 elongated tubular sleeve, inverted inside-out
12 open end of sleeve

14 groove

26 reinforced symmetrical seal defining grasping region

33 area of irregular folds

35 container bag (inverted sleeve)

FIG. 6

11 elongated tubular sleeve, inverted inside-out

26P seal points at base of fingerstalls

33 region of irregular folds

35 container bag (inverted sleeve)

SUMMARY

In accordance, the Method and Apparatus for Removing Animal Extract Excrement, the present disposable, invertible, expandable, sleeved collecting glove comprises an elongated tubular sleeve incasing an interchangeable, symmetrical glove space with an adjacent cover sheet attached harmoniously at the palm, which provides the means for the method and operation to grasp and envelope a mass, and then to invert, and convert into its own inside-out expandable bag to contain and dispose.

DESCRIPTION—FIGS. 1 to 5

FIG. 1 shows that collecting glove 10 is formed from a flattened elongated tubular plastic sleeve 11 that has seal 28 sealed at end 13 by adhesive means or heat sealing means or other means known in the art. The opposite end of sleeve 11 is open end 12. Additionally, there is in sleeve 11 a reinforced symmetrical seal simultaneously formed by the same sealing means as above, that outlines and defines grasping region 26. Grasping region 26 comprises the preferred three fingerstalls: middle fingerstall 21, second fingerstall 22 and third fingerstall 23. Additionally, there is open thumb space or little finger space 24 and open thumb space or little finger space 25, which are of the same size and shape and are open in order to easily accommodate the thumb or the little finger of a left hand or a right hand therewithin. Thus, grasping region 26 of the collecting glove is interchangeable for the right-handed or the left-handed human being. At said end 12, there exists a tab means (not shown) or groove means 14 for easy opening and entry of the hand into the sleeve 11. Sealed end 28 is for aesthetic purposes and convenience, and therefore, does not influence the method or operation.

Figure 2:
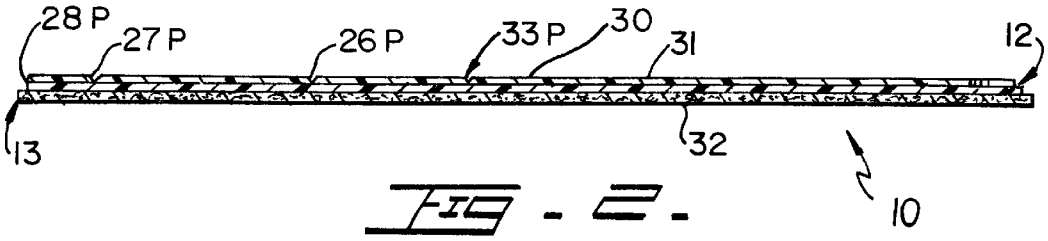
FIG. 2 shows a sectional side view of FIG. 1 illustrating the three layers of the flattened apparatus with the palm-side down and the related points.

FIG. 2 shows that the elongated tubular plastic sleeve 11 includes top plastic layer 30, plastic intermediate layer 31, and absorbent cover sheet 32 attached to layer 31. Said sheet 32 runs approximately the entire length and width of layer 31. It can further be noted where the glove portions are sealed to form the fingerstalls, top layer 30 is sealed to intermediate layer 31 at point 26P for the base portions of the fingerstalls, at point 27P for the tip of first fingerstall 21, and at point 28P for sealed end of sleeve 13. Sealed point 28P is for aesthetic purposes and convenience and does not influence the method.

Figure 3:
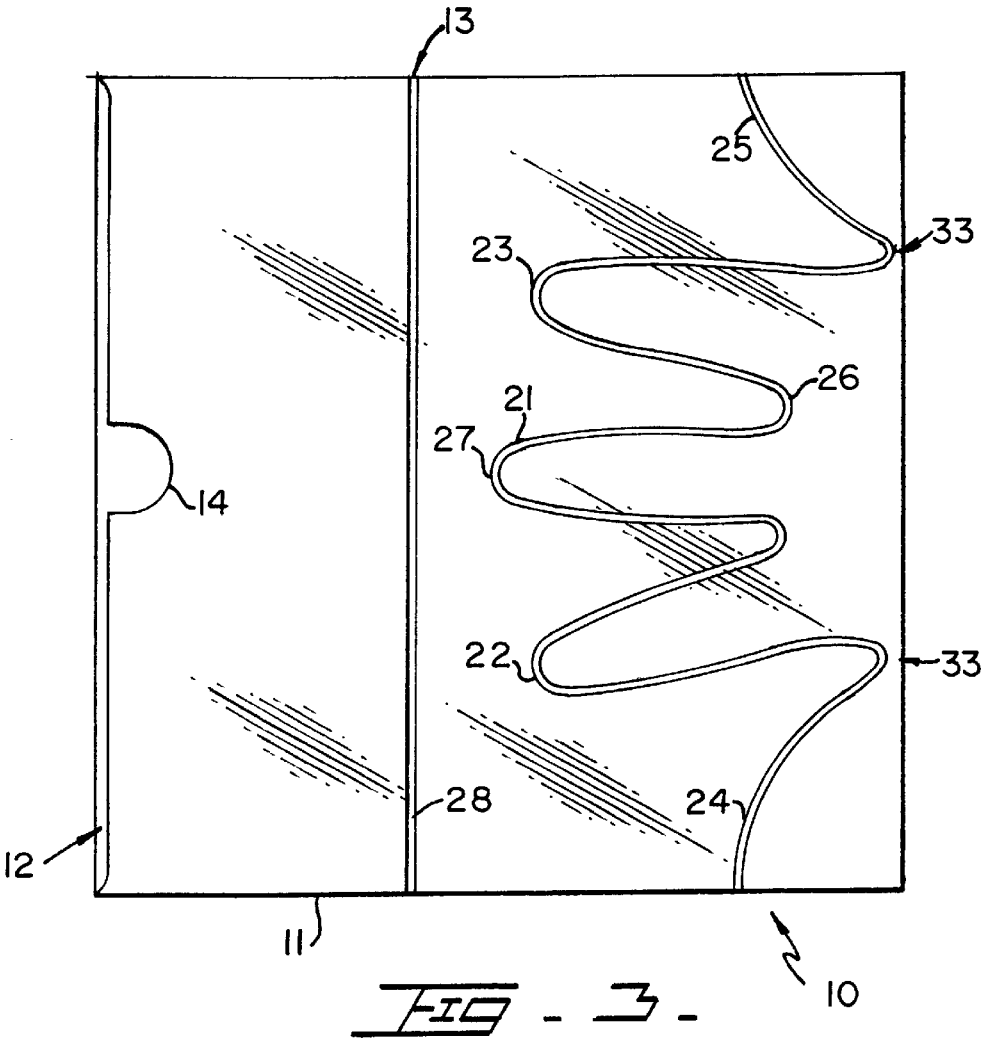
FIG. 3 shows a plan view of the flattened sleeve of FIG. 1 when sleeve inversion is complete, and further shows the region of irregular folds and concealed parts.

FIG. 3 shows the elongated tubular plastic sleeve 11 has been inverted near the palm section of glove 10. Groove means 14 at open end 12 is now inverted inside-out and to the left. Glove 10 is intact to illustrate the simplicity of the inversion. Grasping region 26 is positioned just as before with its component parts shown as concealed: from left to right, sealed end 13, sleeve end seal 28, seal at tip of middle fingerstall 27, middle fingerstall 21, second fingerstall 22, third fingerstall 23, two open thumb and little finger spaces 24 and 25, respectively, and the reinforced symmetrical seal outlines and defines grasping region 26. A new phenomenon reveals itself at this stage. Sleeve 11 is inverted, during a central process of inversion, and said sleeve 11, inside now out, creating the bottom to the container, and is referenced as region of irregular folds 33, and is further described in FIG. 5 and FIG. 6.

Figure 4:
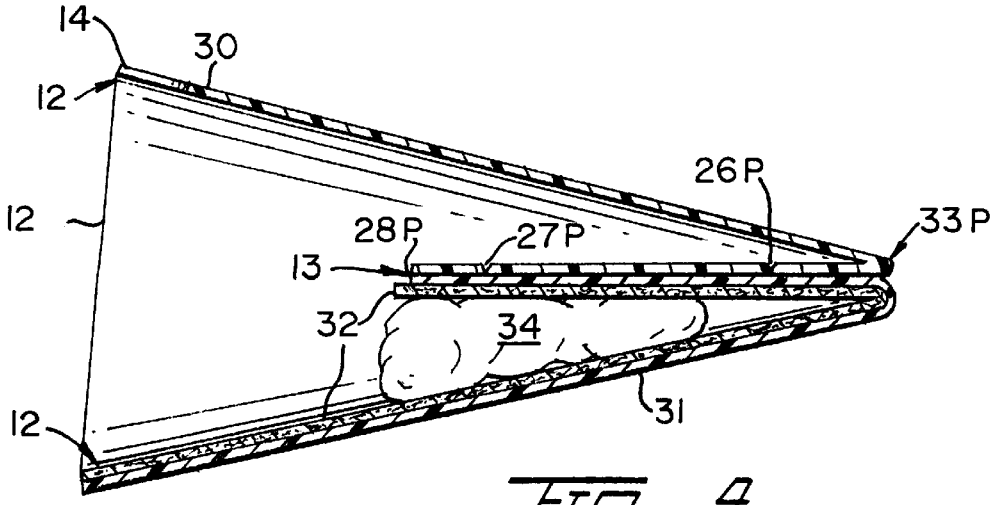
FIG. 4 shows a sectional side view of FIG. 3 slightly open to illustrate the central process of inversion and further shows the relative disposition of the gloved hand and opposite hand and the relation of the enveloped mass in its container.

FIG. 4, a cross sectional view of inverted sleeve 11 (not referenced here), is viewed open at open end 12 to illustrate area of the mass 34. The familiar layers are inverted to the left: top layer 30 is moved up and over and intermediate layer 31 and attached absorbent layer 32 are simultaneously moved down and under to envelope the remaining portion of sleeve 11. This motion is the central process of inversion which takes place in region of the folds 33P involving its contiguous part, grasping region 26. All else remains the same, with one exception: area of mass 34 is revealed and is enveloped between the illustrated layers of absorbent sheet 32.

Figure 5:
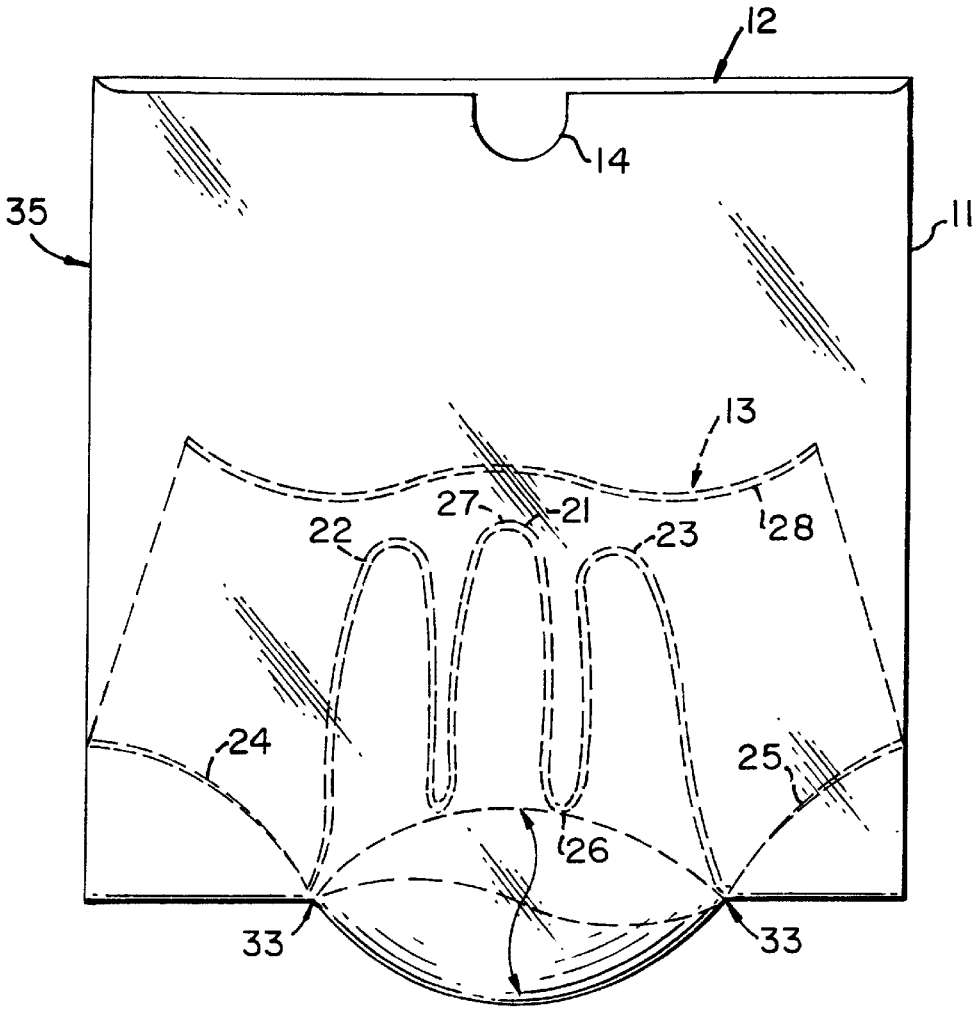
FIG. 5 shows an isometric view of the containing bag and further shows the prolapsed grasping region, and the synonymous region of irregular folds in the mass area.

FIG. 5 shows the resulting container bag 35 in an upright position. The bag 35 evolved out of inverted elongated tubular sleeve 11. Open end 12 and groove 14 are shown at the top to aid in the illustration of region of irregular folds 33, which forms grasping region 26 and all of its component parts of said region 26 prolapse to form the bottom of bag 35.

Figure 6:
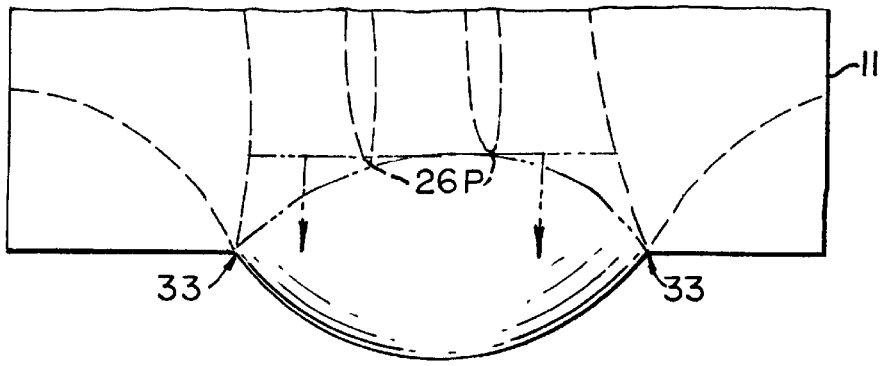
FIG. 6 shows a sectional view of the bottom of the container bag, the synonymous grasping region and region of irregular folds at the central process of inversion.

FIG. 6 shows a section of inverted sleeve 11, the bottom of bag 35. A lateral line through like points 26P illustrates the approximate point at which grasping region 26 will prolapse forming region of irregular folds 33 at the central process of inversion.

From the description above, a number of advantages of the disposal collecting glove become evident:

(a) There are no sharp points or ridged or jagged edges to avoid.

(b) Glove sizes can easily be modified to fit children and adults.

(c) Simplicity of design has many cost saving features.

(d) The unique safety design will encourage even the easily offended user to collect in an adverse situation.

(e) The collecting glove, because of its rectangular sleeve shape can be perforated end-to end and dispensed from rolls like paper towels; or individually packaged as small toy balls for distribution at vending machines.

OPERATIONS—FIGS. 1,2,3,4,5,6

In use, a person desiring to collect an excrement mass would place the glove on the hand, whether on the left hand or the right hand. Either hand will fit into the glove in view of interchangeability of portion 24 and portion 25 for the thumb of either hand and the small finger of either hand. Once glove 10 is on the person's hand (absorbent cover sheet 32 corresponds to the palm of the person's hand and extends approximately the length and width of elongated tubular sleeve 11), said sheet 32 portion is placed down and on the mass. In typical fashion, the mass will be grasped with the thumb and fingers. The width of the glove, along a line (not shown) described by points 24 and 25, is sufficiently wide to allow grasping of a large mass or small mass. It also allows for plenty of room for movement and extension of the fingers and thumb of the person's hand to grab the mass single-handedly. Once the mass is grasped and removed from the ground, the person pulls open end 12 at groove 14 with the other hand. This initiates an action called a central process of inversion which inverts the sleeve, forming a bag with a bottom. As said sleeve 11 of glove 10 is removed from the back of the forearm, down over the wrist and grasping hand in this manner, said sleeve 11 is inverted out to point 33P of region of irregular folds 33 to form the bottom of said bag 35. The inside-out sleeve surrounds and envelopes the mass inside and, at the same time, removes the glove portion from the grasping hand. When this process is completed, said sleeve 11 will now be inside-out. The collected mass will still be surrounded by said sheet 32. The mass, inside said sheet 32, will be inside said sleeve 11 so that said sleeve 11 is now inverted, forming its own container bag 35, containing mass in the area of the mass 34. The remaining three fingerstalls 21, 22, and 23 of the outlined grasping region 26 of said glove 10 also are contained. Open end 12, even though inverted with inside now out, becomes the open top of said bag 35. Said bag 35 can be sealed by a variety of means, whether by rolling or wrapping the remaining said end 12 portion, or tying a knot or a tape or other sealing means enclosing said end 12. The means (not shown) can be provided at said end 12 to facilitate closure means with the mass securely contained in said bag 35.

OPERATIONS, Discussed in Detail—FIGS. 1–6

The script that follows is an in-depth, overall description of parts, their functions, and the overall operations of the central process of inversion of the collecting glove at the complex grasping region, to further explain its novelty and unobviousness.

Therefore, the present invention provides a plastic sleeve glove having one or more fingerstalls and an open thumb space for single-handed grasping of excrement mass. An absorbent cover layer is attached to the bottom of the plastic sleeve to provide additional insulation between the collector's gloved hand and the collected mass. Once the mass is grasped, the sleeve is inverted, into its own containing bag by removing the sleeve from the forearm and grasping hand of the collector in order to envelop the mass and wrap within the inverted sleeve for easy and sanitary disposal of the containing bag and mass.

The preferred embodiment of the glove portion provides for three fingerstalls and the open thumb spaces and little finger spaces and is designed to accommodate different sizes of the users' hands and to be interchangeable to accommodate a left-handed or right-handed collector.

It is important to inform the reader that the structure and outline of the three fingerstalls, by design, are slightly more narrow in width at the base, and are wider at the tips, as if to fan wider. This design was intended, and allows the glove to anchor to the hand, not only while the hand is in a grasping position, but also, when the hand is open in a relaxed and ready position. Therefore, the grasping region stabilizes the glove for the single-handed motion to grasp. Likewise, the structure and outline of the open thumb spaces and little finger spaces, by design, are one in the same space. There are two of them, one on each side of the three fingerstalls. These fingerstalls and open thumb spaces and little finger spaces are simultaneously formed by the reinforced symmetrical seal during manufacturing, and are collectively referred to and defined here and hereafter, as the grasping region.

Also, of importance to the reader, is that this grasping region has a double function as illustrated. It not only plays an important function as the grasping mechanism of the glove, but also, as the inverting sleeve envelopes a collected mass, it prolapses, literally creating a defined region of irregular folds at the center of the palm as the grasping hand is removed. Therefore, the grasping region itself becomes the bottom seal of the inside-out sleeve (bottom of the bag) with collected mass contained, to form what is referred to as an expandable container (bag).

With respect to the reader, please allow this note: the following environmental testing and experimentation took place within the confines of my sanitary kitchen. The substituted staples to represent the shape and the various consistencies of a "collectable mass", were pastry dough and a cake mix. To aid in estimating weight, I used the familiar pound of butter with packaging in quarters, i.e., ¼ pound, ½ pound, and ¾ pound, and all four quarters representing one pound, leaving the packaging in place.

Further testing and experimentation conducted in cold, hot, wet and dry environments confirmed that it is critical to the single-handed method of grasping, and also critical to the stability, smooth operation and function of the glove, while in use, that the configuration, size and proportion of the fingerstalls, whether one or more, and thumb spaces and little finger spaces be appropriately designed, adequately spaced and open, to provide for the lateral movement and extension of the entire hand to completely surround the targeted excrement mass. This is required, whether the state of said mass is moldable, pliable, firm, or frozen in an irregular solid state, to prevent binding or restricting movement of thumb and little finger. As shown before, the preferred symmetrically structured glove embodiment is designed with three fingerstall spaces in the middle, and with one identical open thumb space and little finger space on each side of the three fingerstall spaces. This configuration is absolutely necessary for the collector, whether right-handed or left-handed, to be able to single-handedly maneuver the hand to grasp without binding or restricting the movements required to complete the grasping and removal of a mass within the confines of the collecting glove itself. Otherwise, both hands are required for grasping!

And finally, testing and experimentation further confirms that this engineered design is unique to the collecting glove. The predetermined proportions, precisely the length and, more important, the width of the flattened tubular sleeve, in combination with the designed symmetry of the defined grasping region, while communicating with the attached absorbent cover sheet, provide the sliding means by which the elongated sleeve can be inverted, to turn partially inside out, to convert into the inside-out plastic bag. More simply, when in use, the hand opposite the gloved hand is moving away from the gloved hand. The opposite hand has pulled the sleeve open and away from the wrist and grasping hand. With this in mind, the phenomenon of inverting the sleeve into the inside-out plastic bag is only achieved, when, the unique symmetry allows the preferred three fingerstalls to act as the anchor to the gloved hand, holding the glove in place, while the thumb and little finger are free to grasp, within the open spaces, during the manipulation of the grasping region, and during the inversion of the tubular sleeve. During this process, the thumb and little finger, exerting pressure only in the grasping position, are free from binding at all times. They are therefore first to be released and removed from their spaces as the slidable sleeve inverts. The three fingers of the gloved hand, while still anchored in the fingerstalls, then release and are easily removed from the base of the fingerstalls of the grasping region, leaving the fingerstalls concealed inside the bag at the bottom. Therefore, the unique reinforced symmetrical seal originally forming the spaces for entry of the fingers and thumb of the hand, are again void of the hand. As intended, the seal folds at the base of the grasping region at the palm of the hand, to form the irregular folds that form the bottom of the resulting container. As is now apparent, the grasping region and the region of the folds have become one function and have formed the bottom of the container bag. The open end of the inverted sleeve and its remaining cuff (not referenced) have become the top of an inside-out plastic container bag, and can be wrapped to safely seal and dispose.

OPERATIONS, Demonstrated—FIGS. 3–6

The central process of inversion referring to FIG. 3, is demonstrated as the elongated tubular sleeve is completely inverted to form its own inside-out bag (not referenced) and can clearly be observed as we recognize that open end 12 and groove 14 that once provided easy access and entry of a hand into the elongated tubular plastic sleeve 11 are now to the left. Looking from left to right, sealed end of sleeve 13 and sleeve end seal 28 of glove 10 are in tact and are completely enveloped along with the reinforced symmetrical seal defining grasping region (26). Please note: in reality, absorbent cover sheet 32 is also intact and completely envelopes the excrement mass, but said sheet and mass are not illustrated here. Remarkably, what is now shown is region of irregular folds 33 that formed as grasping region 26 prolapsed at the precise moment sleeve 11 completely inverts. Folds 33 and region 26 then become the bottom of the inside-out bag. The irregularity in folds 33 is due to inconsistent variables, such as the size, the shape, the weight, and the consistency of the collected mass and the amount of pressure exerted at the time of collection. It is interesting to note that folds 33 can open out (FIG. 5 and FIG. 6) as an accordion might, to allow for extra containing space if needed.

Referring to FIG. 4, the illustration may appear complicated but is intended to clarify the relative disposition of the gloved hand of the collector and the opposite hand, and also the enveloped excrement mass after collection in relation to the inside-out bag. While in motion, the opposite hand still clutches open end 12 at groove 14 as the central process of inversion is near completion. End 12 is held firmly by the opposite hand to the gloved hand, and in this case as we look from left to right, we imagine the left hand holding end 12 at groove means 14. The gloved hand or the right hand in this case, has simultaneously been freed from (refer to FIG. 3) the preferred three fingerstalls 21, 22, 23 comprised within grasping region 26, at region of irregular folds 33. Again referring to FIG. 4, note area of the mass 34, the mass being at last enveloped within absorbent sheet 32 and now occupies area of the mass 34. It is important to note here, that nothing has changed as far as the apparatus itself; nothing new has been added except, in reality, the collected mass itself. The mass is not shown, only the approximate area to be occupied by the enveloped mass. As is illustrated, a greater portion of top layer 30 and a greater portion of intermediate layer 31 and the corresponding portion of aforesaid sheet 32 show the inversion complete at folds 33, forming the bottom of the anticipated containing bag within the confines of inverted sleeve 11. To express the action in another way, the opposite hand has pulled top layer 30 over the gloved hand and has moved in the opposite direction to envelope everything in its way. In like manner, and simultaneously, intermediate layer 31 along with sheet 32 have also moved in the opposite direction at the exact same time, enveloping every thing in its way. This leaves all else intact to form folds 33 at point 33P, thus forming the bottom of inside-out sleeve 11 shown in FIG. 5, and referenced as, simply, container bag 35. From point 33, the remaining referenced parts and points remain in tact and are contained, namely, from right to left, seal point base of fingerstalls 26P, seal point tip of middle fingerstall 27P, end seal 28P, and closed end 13.

Referring to FIG. 5 and FIG. 6, the isometric views show the resulting container bag 35. In use, glove 10 while not referenced here, but still encased in elongated tubular plastic sleeve 11 has been converted into a finished bag, and bag 35 is shown in an upright position revealing the familiar open end 12 and associated groove 14. Also referenced here again is sleeve 11, showing sleeve 11 has inverted itself inside-out to reveal bag 35. In this view the top and the two sides of bag 35 are characteristically straight, but the bottom of bag 35 is irregular in shape. At approximately this location, one can observe region of irregular folds 33. Folds 33 generally form and run from side to side, as one might expect, but, during testing, however, it was often evident folds 33 can change directions to run front to back, back to front, as indicated by the illustrated, unfamiliar double arrow wave. Folds 33 form and bulge out, depending on the pressure applied at the time of collection, the size, the shape, the weight, and the consistency of the contained object in bag 35, in this case, the collected mass. As anticipated, folds 33 are the result of the prolapsing grasping region 26. Region 26 can prolapse even more, allowing for more bulging, to satisfy space requirements and sanitarily contain the mass. Then it can be wrapped to secure until such time as bag 35 and all of its contents can properly be disposed. All other referenced parts of glove 10 are contained within bag 35. In numerical order they are sealed end of glove 13, middle fingerstall 21, second fingerstall 22, third fingerstall 23, open thumb spaces or little finger spaces 24 and 25, and sleeve end seal 28.

Therefore, from this description, a number of advantages to add to the previous list becomes evident.

(a) No sharp or rigid edges are present to cause injury.

(b) Expandable capacity accommodates small and large masses.

(c) Ease of manufacture, distribution, use and disposal make this product tempting.

(d) Use of this product will ennoble many unpleasant tasks in the bathroom, sickroom, garage, hospital and many commercial establishments.

(e) This product is sized for use by children as well as adults.

(f) Presentation in a perforated roll makes this product simple to dispense.

(g) Safety is enhanced by the wide area of the absorbent sheet; there will be no spills even if the glove is turned up-side down.

(h) It is further anticipated that a cuff portion on the sleeve can include a closure means such as a rubber band or tape or other attachment to secure the mass after the plastic sleeve is inside out.

(i) The apparatus may further include a snap handle or other means for maintaining a supply of packaged disposable gloves, or the wrapped, inside-out plastic bag and mass in a closed position, after use.

SUMMARY, RAMIFICATIONS, AND SCOPE

Accordingly, the reader will see that the simplistically engineered and cleverly designed collecting glove can be used as the Method And Apparatus For Removing Animal Extract Excrement. As outlined in "OBJECTS AND ADVANTAGES," referenced as (a) through (r), the collective means to prompt, provide and promote the action to sensitize and motivate people to address this disgusting problem, must be done with emphasis on safety, convenience, effectiveness, economy, sanitation and ecology.

Points to consider about the Method And Apparatus For Removal Of Animal Extract Excrement with reference to this collective action means are, respectively:

- the collecting glove provides and promotes the safety and the better health theme of the community pick-up campaign;
- it allows the pet owner the convenience of the clean-up at the most inconvenient moments, with no social embarrassment;
- it permits the effective use of the glove to target quickly and effectively to clean the area of deposit;
- it economically contributes to the clean-up effort in that the glove is affordable by most responsible citizens;
- it provides sanitary awareness to our society, prompting the clean up of our parks, residential areas and other public places wherever an animal may deposit (the glove is clean on the outside both before and after use and not much bigger in size than a baseball);
- it provides for the ecology in that it can be disposed just as easily as a soiled diaper, noting that the disposable glove after use is probably more sanitary than the diaper because of the enveloping absorbent sleeve wrap.

In addition to the problem collective solving means above, the following is of much importance:

- the tubular plastic material can be a polymer of thin gauge, sufficiently flexible to be invertible, and sufficiently strong to grasp such a mass, and to contain the mass for sufficient time until the collecting glove and its mass can be properly disposed;
- the preferred size of the plastic tubular sleeve and glove would be 25.5 mm wide and 42.5 mm long, or 11 inches by 17 inches; however, it can be changed in size to accommodate a smaller hand size or a larger hand size;
- it is also believed that for decorative purposes, designs, colors and textures can be placed on the tubular plastic material to enhance the aesthetic design of same;
- the absorbent cover layer or sheet attached to the bottom of the plastic sleeve on the palm side, not only provides additional insulation between the collector's hand and collected mass, but conceivably could be the medium for application of other substances such as disinfectants or deodorizers or aromatic fragrance, or other non-toxic chemicals;
- it is anticipated that collecting gloves, with or without the absorbent sheet, can be cut from a continuous roll of said tubular sleeve plastic at connecting end locations of successive gloves and rendered as the disposable glove, or perforated from a continuous roll of said tubular sleeve plastic at connecting end locations of successive gloves and rendered as a continuous, tear-off disposable glove from a roll as one might tear off a section of paper towel to remove it from its roll.
- it is conceivable that, since the collecting glove can be compressed, as wadding in the palm of the hand without damaging, that another way to convenient market would be to package a single one to resemble a small bright red or yellow toy ball, too large to fit into a child's mouth, but just right for the vending machines, making them even more accessible;
- and finally: no one said, "collecting could be fun". The truth is . . . it can be! Just as recycling is trend: civility is becoming trend, and "collecting the mass" must become trend, too.

Although the description above contains many specificities, these should not be construed as limiting the scope of the invention but as merely providing illustration of some of the presently preferred embodiments of this invention. For example, the sleeve and glove can have other uses rather than just for disposing of undesirable mass; the sleeve or glove can have other shapes, such as circular, oval, square, triangular, even cupped and padded in the fashion of a disposable diaper, etc.; the symmetry of the fingerstalls and spaces can have rounded ands or tapered ends, or can be longer or shorter or wider; can even have more or less than two fingerstalls; and the symmetry can be asymmetrical, etc.

Thus the scope of the invention should be determined by the appended claims and their legal equivalents, rather than by the examples given.

I claim:

1. A collecting glove comprising a flat elongated tubular sleeve body sealed at one end and open at its opposite end, said flat tubular sleeve body having a first layer and a second layer, each with inner and outer sides, said layers forming parallel edges, said first layer having a grasping region between said sealed end and said open end, said first layer having a sealing edge of predetermined proportions in said grasping region, a third layer of absorbent material attached to the outer side of said second layer, said sealing edge formed by joining the inner side of said first layer to the inner side of said second layer and said sealing edge extending between said parallel edges.

2. The collecting glove of claim 1 wherein said first layer and second layer are composed of thin gauge flexible plastic, and said plastic is of substantial organic material.

3. The collecting glove of claim 1 wherein said grasping region comprises one or more fingerstalls and thumb spaces and little finger spaces of predetermined proportion.

4. The collecting glove of claim 1 wherein said sealing edge forms a plurality of fingerstalls, with thumb spaces and little finger spaces on each side of said fingerstalls.

5. The collecting glove of claim 4 wherein said grasping region is positioned approximately two thirds of the length of said tubular sleeve body nearer said sealed end opposite said open end.

6. The collecting glove of claim 1 wherein said absorbent material attached to said second layer covers approximately the length and width of said glove.

7. A method for removing animal excrement using a collecting glove of the type comprising a flat elongated tubular sleeve body sealed at one end and open at its opposite end, said flat tubular sleeve body having a first layer and a second layer, each with inner and outer sides, said layers forming parallel edges, said first layer having a grasping region between said sealed end and said open end, said first layer having a sealing edge of predetermined proportions in said grasping region a third layer of absorbent material attached to the outer side of said second layer, said sealing edge formed by joining the inner side of said first layer to the inner side of said second layer and said sealing edge extending between said parallel edges.

8. A method for removing animal excrement using a collecting glove of claim 7 wherein said first layer and said second layer is composed of thin gauge flexible plastic, and said plastic is of a substantial organic material.

9. The method for removing animal excrement using a collecting glove of claim 7 wherein said grasping region comprises one or more fingerstalls and thumb spaces and little finger spaces of predetermined proportion.

10. A method for removing animal excrement using a collecting glove of claim 7 wherein said glove is used to hold a mass to be picked up, clutching said glove at said open end to initiate the process of inversion, turning said tubular sleeve inside-out, whereby causing said grasping region to prolapse forming a region of folds which, in combination with said grasping region, becomes the bottom of a container bag, whereby completing the process of inversion and expansion of said bag.

* * * * *